US006903690B2

(12) United States Patent
Leclerc et al.

(10) Patent No.: US 6,903,690 B2
(45) Date of Patent: Jun. 7, 2005

(54) INTERNAL ANTENNA OF SMALL VOLUME

(75) Inventors: Daniel Leclerc, Crissey (FR); Ayoub Annabi, Dole (FR); Frédédric Diximus, Dole (FR)

(73) Assignee: Amphenol Socapex (FR)

( * ) Notice: Subject to any disclaimer, the term of this patent is extended or adjusted under 35 U.S.C. 154(b) by 14 days.

(21) Appl. No.: 10/713,048

(22) Filed: Nov. 17, 2003

(65) Prior Publication Data

US 2005/0078037 A1 Apr. 14, 2005

(51) Int. Cl.[7] ..... H01Q 1/38
(52) U.S. Cl. ..... 343/700 MS; 343/702; 343/846
(58) Field of Search ..... 343/700 MS, 702, 343/846, 848

(56) References Cited

U.S. PATENT DOCUMENTS

| | | | | |
|---|---|---|---|---|
| 6,384,786 | B2 * | 5/2002 | Ito et al. | 343/700 MS |
| 6,456,249 | B1 | 9/2002 | Johnson et al. | 343/702 |
| 6,600,449 | B2 | 7/2003 | Onaka et al. | 343/700 MS |
| 6,788,257 | B2 * | 9/2004 | Fang et al. | 343/700 MS |

FOREIGN PATENT DOCUMENTS

| | | |
|---|---|---|
| EP | 1 109 251 | 6/2001 |
| EP | 1 128 466 | 8/2001 |
| EP | 0 814 535 | 7/2003 |
| WO | WO 02/50948 | 6/2002 |

* cited by examiner

*Primary Examiner*—Hoang V. Nguyen
(74) *Attorney, Agent, or Firm*—Blank Rome LLP

(57) ABSTRACT

An internal antenna of small volume comprising:

a conductive ground plane;

a first conductive surface placed in an antenna plane substantially parallel to the ground plane and partially surrounding a portion of the antenna plane, and presenting first and second ends;

a second conductive surface forming a main radiating assembly disposed essentially in said portion of the antenna plane, said two conductive surfaces not being connected together by any conductive electrical connection;

an antenna conductor connected to said second conductive surface;

first electrical connection means for connecting a first end of the first conductive surface to a first zone of the ground plane; and second electrical connection means for connecting said first surface at least in the vicinity of the second end of the first conductive surface to a second zone of the ground plane that is distinct from the first zone;

the assembly constituted by said first conductive surface, the portion of the ground plane electrically interconnecting the first and second zones, and the two connection means presenting an opening.

13 Claims, 6 Drawing Sheets

INTERNAL ANTENNA OF SMALL VOLUME

The present invention relates to an internal antenna of small volume.

More precisely, the present invention relates to an. antenna which can be disposed axially inside the housing of an electronic appliance of very small thickness, the antenna including its own ground plane, or co-operating, for example, with printed circuits having metallization suitable for acting as the equivalent of a ground plane.

The manufacturers of mobile telephones tend to offer appliances of smaller and smaller size and also of smaller and smaller thickness.

In order to reduce size, so-called "internal" antennas are used, i.e. antennas which are located entirely inside the housing of the mobile telephone.

As internal antennas, it is possible to consider using so-called "PIFA" antennas, which are essentially constituted by a radiating element, and which must necessarily operate together with a ground plane. In order to ensure that the antenna operates well, the ground plane must be disposed at a distance of about 7 millimeters (mm) from the radiating element for the GSM frequency bands of 900 GHz to 1800 GHz. The total thickness of the antenna can be too thick for it to be usable in mobile radiotelephones of very small size. Faced with this difficulty, proposals have been made to use external antennas of very small thickness. The problem which is encountered with such antennas offset from the ground plane is that their performance is degraded if the ground plane is small. In addition, the specific absorption rate (SAR) of the electromagnetic field is high.

An object of the present invention is to provide an internal antenna of very small volume, the ground plane naturally being preferably that of the appliance in which the antenna is mounted.

According to the invention, this object is achieved by a small volume antenna comprising:

- a conductive ground plane;
- a first conductive surface placed in an antenna plane substantially parallel to the ground plane and partially surrounding a portion of the antenna plane, and presenting first and second ends;
- a second conductive surface forming a main radiating assembly disposed essentially in said portion of the antenna plane, said two conductive surfaces not being connected together by any conductive electrical connection;
- an antenna conductor connected to said second conductive surface;
- first electrical connection means for connecting a first end of the first conductive surface to a first zone of the ground plane; and
- second electrical connection means for connecting said first surface at least in the vicinity of the second end of the first conductive surface to a second zone of the ground plane that is distinct from the first zone;
- the assembly constituted by said first conductive surface, the portion of the ground plane electrically interconnecting the first and second zones, and the two connection means presenting an opening.

It will be understood that in this antenna, a first portion of the radiating element is constituted both by a first conductive surface placed in an antenna plane parallel to the ground plane and by the ground plane itself. A main radiating element constituted by a second conductive surface is disposed in the space defined by said first portion of the radiating element. This configuration can operate in highly satisfactory manner with a distance of 2 mm to 3 mm being provided between the ground plane and the antenna plane in which the first conductive surface and the major part of the second conductive surface are disposed.

The term "not being connected together by any conductive electrical connection" means that the only connection that might possibly exist between the two conductive surfaces consists in capacitance, self-induction, or a combination of these components.

The term "for connecting said first surface at least in the vicinity of the second end of the second surface to the ground plane" means that the electrical connection has one end connected to the first surface either directly at its second end or else close to its second end so that only a small portion of said first surface extends beyond the point of connection.

It will thus be understood that by means of the antenna of the invention, the conductive surfaces forming the radiating element can be disposed at a very small distance from the ground plane, which is naturally preferably the ground plane of the appliance in which the antenna is mounted.

In a first embodiment, the first and second conductive surfaces are made on a face of an insulating support or a dielectric substrate that is substantially parallel to the ground plane.

In a second embodiment, the first and second conductive surfaces are cut-out pieces of metal sheet which are connected to the ground plane and are mounted thereon. These portions may be mechanically connected by an adhesive tape of the high temperature Kapton type.

Preferably, in the second embodiment, said first and second electrical connection means are extensions of the piece of sheet forming the first conductive surface, said extensions being bent through a right angle and having ends bonded to the ground plane.

According to another characteristic of the invention, the opening is formed in said first conductive surface. In another variant embodiment, the opening is made in the ground plane on the electrical path interconnecting said two connection zones.

Also preferably, the antenna includes impedance-matching means between said first and second conductive surfaces.

Also preferably, the antenna has second impedance-matching means which are mounted on the assembly constituted by the first conductive surface and the portion of the ground plane interconnecting the connection zones.

Also preferably, the second impedance-matching means are constituted by an open-ended slot made in the ground plane.

Other characteristics and advantages of the invention appear better on reading the following description of various embodiments of the invention given as non-limiting examples. The description refers to the accompanying figures, in which.

Figure 1:
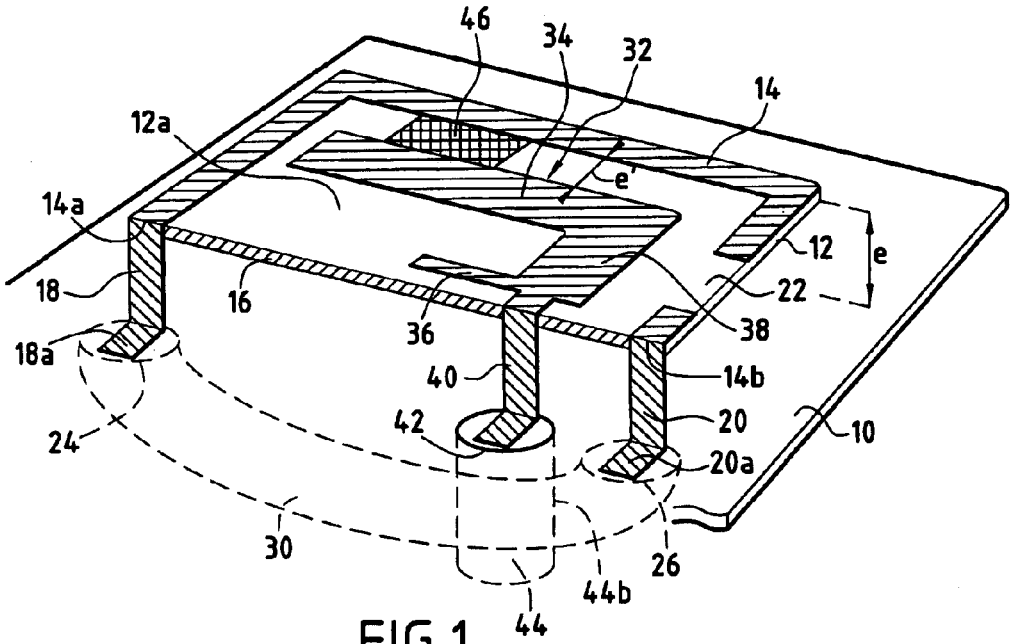
FIG. 1 is a simplified view of a first embodiment of the antenna showing the principle on which the antenna is made.

With reference initially to FIG. 1, a simplified embodiment of the antenna is described to set out the principles on which it is made. This figure shows a ground plane 10 which is preferably the ground plane of the appliance in which the antenna is mounted, particularly when the appliance is a mobile telephone. The dimensions of the ground plane may be 105 mm×35 mm. In this embodiment, the antenna includes an insulating support 12 or a dielectric substrate of thickness 0.8 mm and of dimensions 31 mm×13 mm which is held parallel to the ground plane 10 by means not shown. The distance e between the substrate or insulating support 12, and the ground plane 10 lies in the range 2 mm to 3 mm. It can thus be seen that the complete antenna presents a volume that is very small. On the insulating support 12, e.g. substantially rectangular in shape, there is made a first conductive surface 14, e.g. in the form of first metallization. This first metallization 14 may follow three of the edges of the insulating support 12, while leaving one edge 16 thereof free. More generally, the first metallization 14 surrounds a portion 12*a* of the insulating support in part. The first metallization has two ends given respective references 14*a* and 14*b* which are extended by two bent conductive tabs 18 and 20, the free ends 18*a* and 20*a* of these tabs being bonded by a conductive material to the ground plane 10. In this embodiment, the first conductive surface 14 has an opening 22 which is thus made on the insulating support 12. With reference to the connection zones 24 and 26 of the conductive tabs 18 and 20, the first conductive surface 14, with the exception of its opening 22, forms a closed electric circuit which is looped by the portion 30 of the ground plane that is represented in simplified manner by dashed lines in FIG. 1.

The antenna has a second conductive surface 32 which, in this embodiment, is formed entirely on the top face of the insulating support 12 which is preferably a dielectric substrate made of FR4 type epoxy-impregnated fiberglass. This conductive surface 32 is made on the portion 12*a* of the insulating support which is partially surrounded by the first conductive surface. In the embodiment shown in FIG. 1, the second conductive surface 32 is constituted by two conductive elements 34 and 36 interconnected by a connection zone 38. This second conductive surface 32 shown in FIG. 1 corresponds to the case where the antenna is to have frequency passbands that are sufficient for the intended operation. The connection zone 38 is connected by a bent conductive tab 40 to a connection zone 42 of an antenna conductor 44 in such a manner that this conductive tab connects the axial conductor of the antenna cable 44 to the connection zone 38 (see FIG. 3).

Taking the above-described conductive surfaces as a whole, it can be considered that there is a first conductive assembly constituted by the first metallization 14, by the connection tabs 18 and 20, and by the electrical path 30 interconnecting the two connection zones. This first conductive assembly is provided with an opening 22. In the space surrounded by the first conductive assembly as described above there is disposed the second conductive surface 32 which constitutes the main part of the radiating element of the antenna, the first conductive surface also constituting a radiating element.

Figure 3:
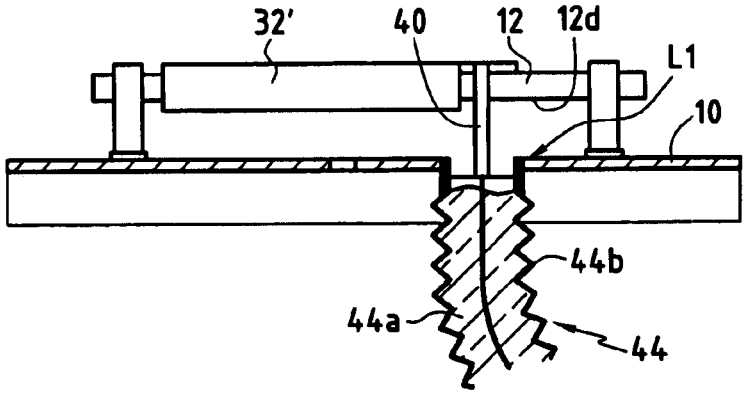
FIG. 3 is a side view of the FIG. 2 antenna.

Naturally the shielding 44*b* of the antenna cable 44 is connected to the ground plane 10: in the zone referenced L1 (FIG. 3).

The antenna preferably also has first impedance-matching means represented symbolically by reference 46 between the two conductive surfaces 14 and 32. These first impedance-matching means are preferably obtained by ensuring that the distance e' between the first conductive surface and the second conductive surface over a given length has a value that is suitable for obtaining the desired impedance.

Figure 1A:
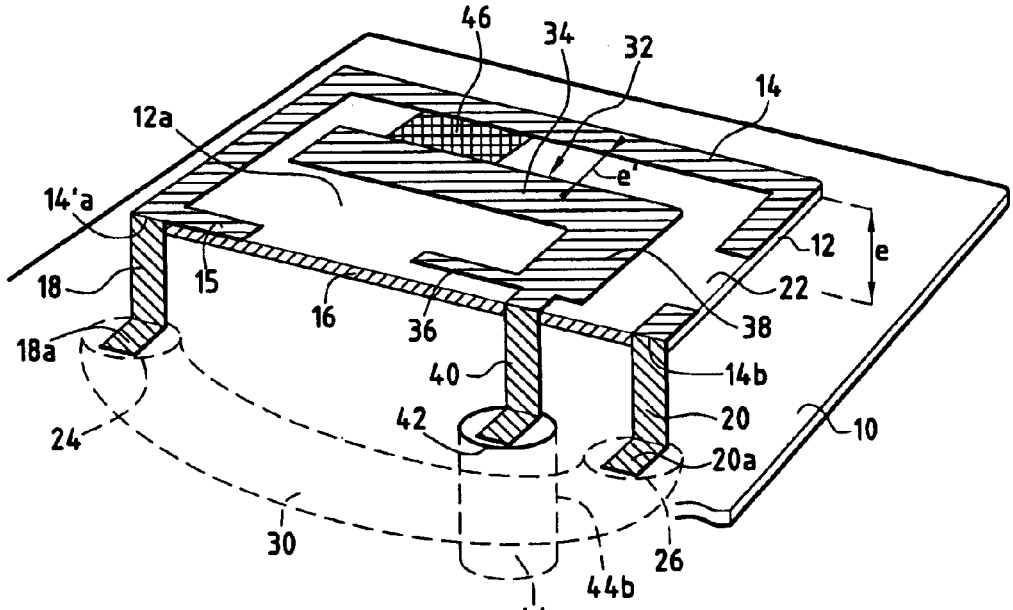
FIG. 1A shows a variant of the antenna shown in FIG. 1.

The embodiment of FIG. 1A differs from that of FIG. 1 only with respect to the following point:

The first conductive surface 14 is extended by a short conductive portion 15 which extends away from the connection point 14'*a* between the tab 18 and said first surface.

Figure 2:
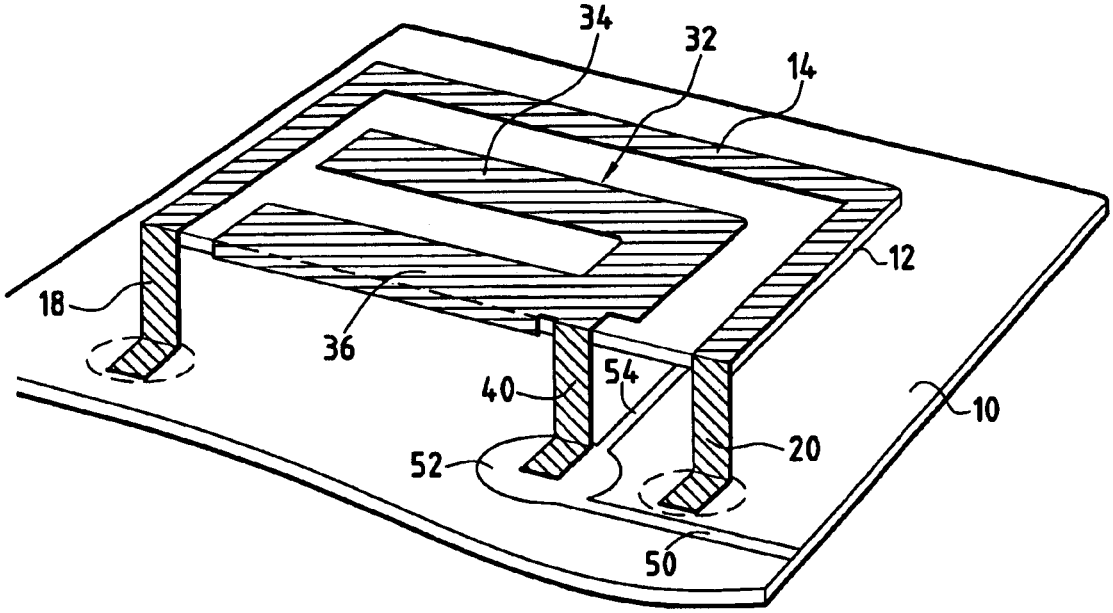
FIG. 2 is a more detailed perspective view of an embodiment of the antenna when the conductive surfaces are made on a dielectric substrate.

With reference now to FIGS. 2 and 3, there follows a description in greater detail of how an antenna of the type shown in FIG. 1 is embodied. In this figure, there can be seen the insulating support 12, the ground plane 10, the first conductive surface 14 (it should be observed that it does not include the opening 22), and the connection tabs 18 and 20 for the first conductive element. There can also be seen the second conductive surface 32 with its two portions 34 and 36 and its connection tab 40 to the central conductor of the antenna cable 44.

In the particular embodiment shown in FIGS. 2 and 3, it can be seen that it is possible for the second conductive surface 32 to be made not only on the top first face 12*b* of the insulating support 12, but also by a portion 32' made on the edge face of the insulating support and on its bottom face 12*d*. This disposition serves to increase the area of the second conductive surface without increasing the space occupied by the antenna.

This figure also shows an open-ended slot 50 in the ground plane 10 going from the non-metallized zone 52 surrounding the connection point of the antenna to the edge of the ground plane. Functionally, this slot 50 performs exactly the same role as the opening 22. In this figure, there can also be seen a second slot 54 made in the ground plane and constituting second impedance-matching means. This slot 54 is connected to the open slot 50. It is thus itself functionally open. FIG. 3 shows more clearly the connection with the antenna coaxial cable 44. In particular, there can be seen the electrical connection between the shielding 44*b* of the cable and the ground plane 10, and the connection between the central conductor 44*a* and the connection tab 40. The shielding of the cable 44 is connected to the ground plane 10 in the zone referenced L1.

In this embodiment, the distance e between the conductive surface made on the dielectric substrate 12 and the ground plane lies in the range 2.5 mm to 3 mm, the thickness of the insulating support being about 0.8 mm, and the dimensions of the insulating support substrate 12 possibly being 13 mm by 31 mm. It can thus be seen that the antenna of the invention is effectively of small thickness and also presents a volume that is very small (less than or equal to 1 cubic centimeter ($cm^3$)). By means of its disposition, this antenna includes its own ground plane which, as mentioned above, is preferably the ground plane of the appliance in which the antenna is mounted.

Figure 4:
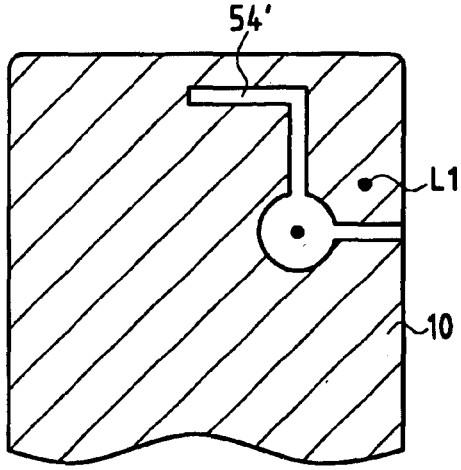
FIGS. 4 to 6 show various embodiments of the second impedance-matching means on the ground plane.
Figure 5:
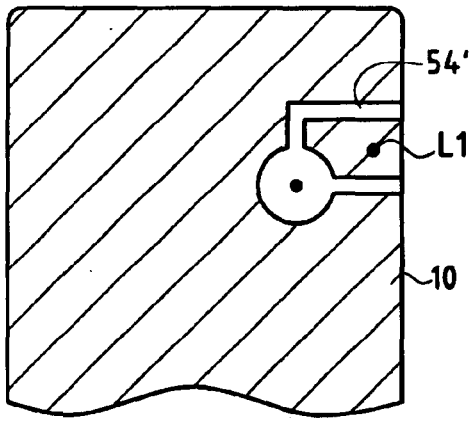
Figure 6:
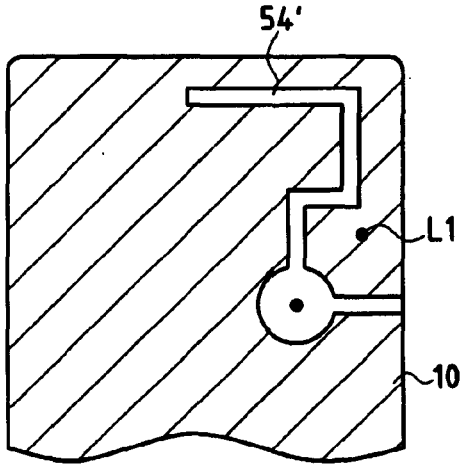

FIGS. 4 to 6 show various examples of shapes 54' for the slot made in the ground plane to constitute the second impedance-matching means and which are connected to the open-ended slot 50. In FIG. 5, the slot 54' is open-ended at both ends.

In these figures, L1 represents the point of connection with the shielding of the antenna conductor 44.

Figure 7:
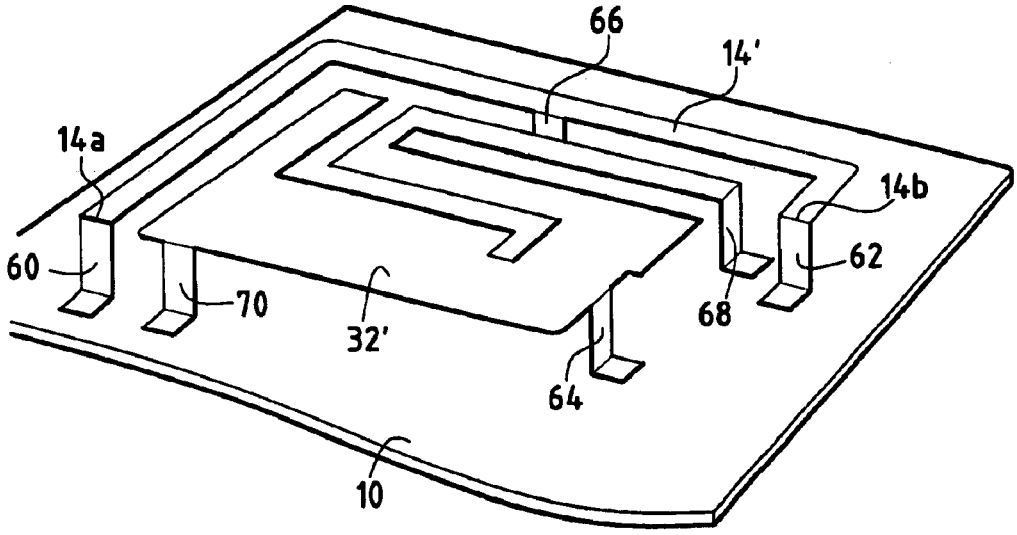
FIG. 7 is a perspective view of an embodiment of the antenna in which the two conductive surfaces are made using cut-out portions of sheet metal.

FIG. 7 shows a variant embodiment in which the conductive surfaces constituting the radiating assembly are made as cut-out pieces of conductive sheet metal. In this figure, there can be seen the first conductive surface referenced 14' which presents a first end 14*a* connected to the ground plane by a bent tab 60 and a second end 14*b* connected to the ground plane by a second bent tab 62. The second conductive surface is constituted by a piece of sheet metal given overall reference 32' and disposed in the same plane as the sheet 14'. The sheet 32' is cut in such a manner that the overall radiating element is tuned to the wavelengths in which the antenna is to operate. The connection zone of the antenna is connected by a conductive tab 64 to the antenna cable 44 (not shown). In order to ensure that the two pieces of sheet metal 14' and 32' constituting the two conductive surfaces have sufficient mechanical strength, these pieces of sheet metal are provided with mechanical support tabs such as 64, 66, 68, and 70. Naturally, these tabs 66, 68, 70 must not constitute electrical connections with the ground plane 10. They are therefore bonded to the support of the ground plane in zones that do not have any metallization as can be seen more clearly in FIG. 7A. In the example shown in FIG. 7, the first conductive surface constituted by the sheet 14' does not have an opening as shown in FIG. 1. This opening is again constituted by an open-ended slot 72 made in the ground plane.

Figure 7A:
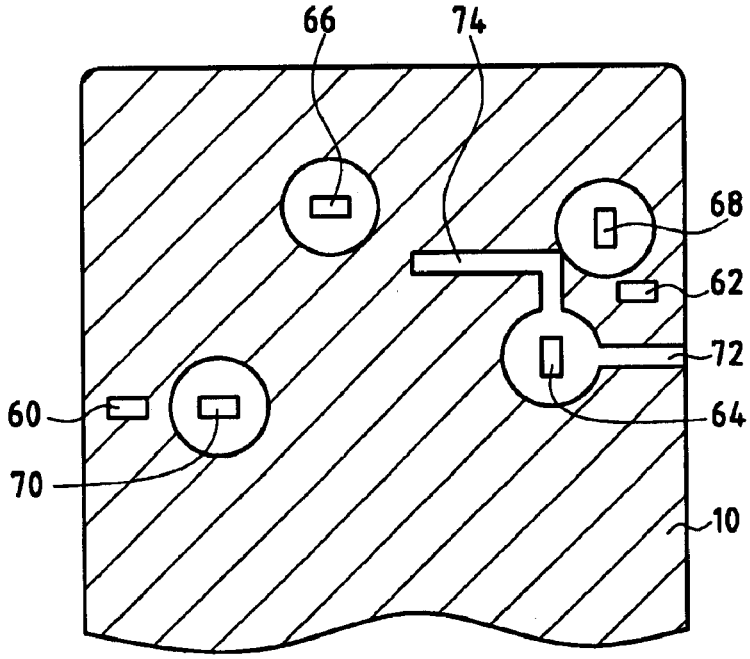
FIG. 7A is a plan view of the ground plane of the FIG. 7 antenna.

FIG. 7A shows the ground plane 10 in plan view to show in particular the connection zone of the tab 64 connected to the central conductor of the antenna coaxial cable, a slot 72 which is open-ended and which acts functionally as the opening 22 formed in the first conductive surface of the FIG. 1 antenna, and a second slot 74 which does not have an open end in the periphery of the ground plane and which advantageously constitutes the second impedance-matching means.

Figure 8:
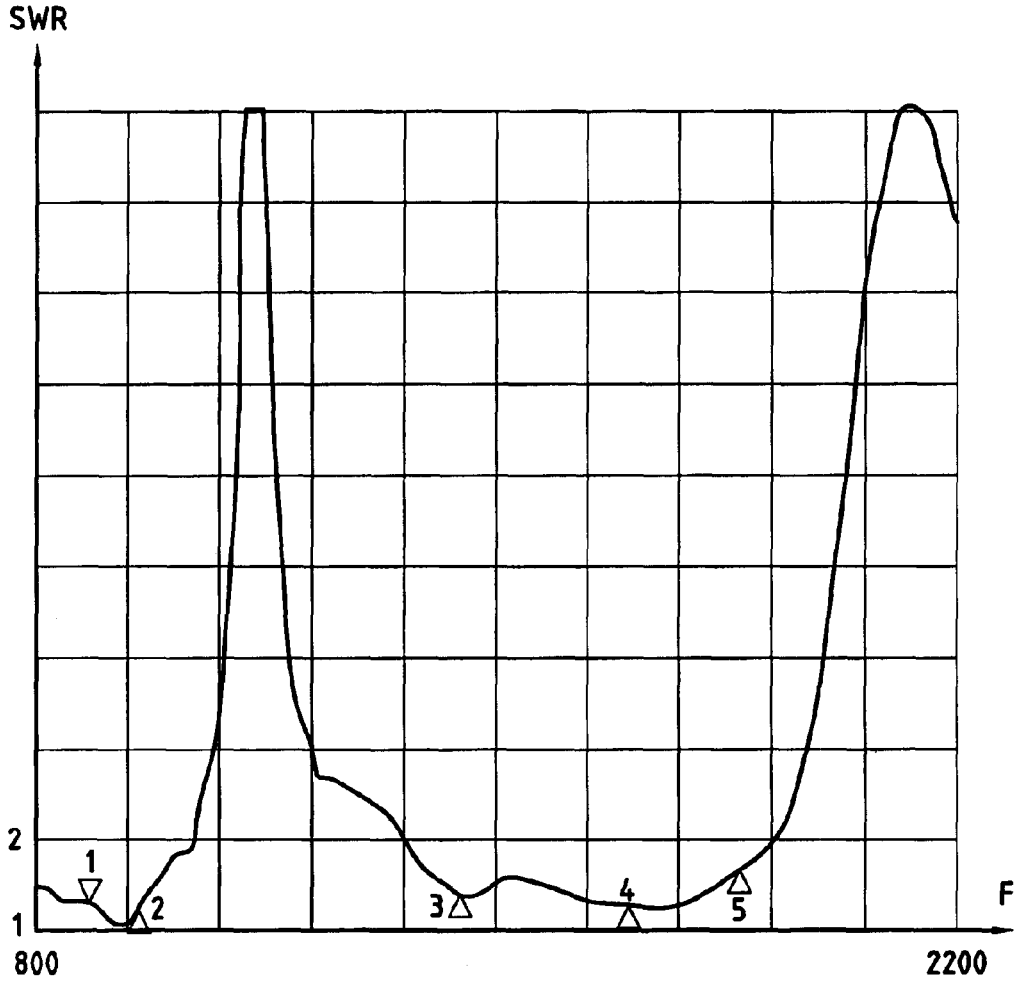
FIG. 8 is a graph plotting variations in standing wave ratio (SWR) as a function of frequency for an antenna in accordance with the invention.

FIG. 8 is a curve plotting SWR for an antenna of the invention as a function of frequency (F). This antenna corresponds more particularly to the embodiment of FIG. 2 with the ground plane shown in FIG. 4.

Mark 1 corresponds to 880 MHz (megahertz), mark 2 to 960 MHz, mark 4 to 1710 MHz, and mark 5 to 1880 MHz. It can be seen that very wide passbands are obtained in the frequency ranges used in telephony.

Figure 9:
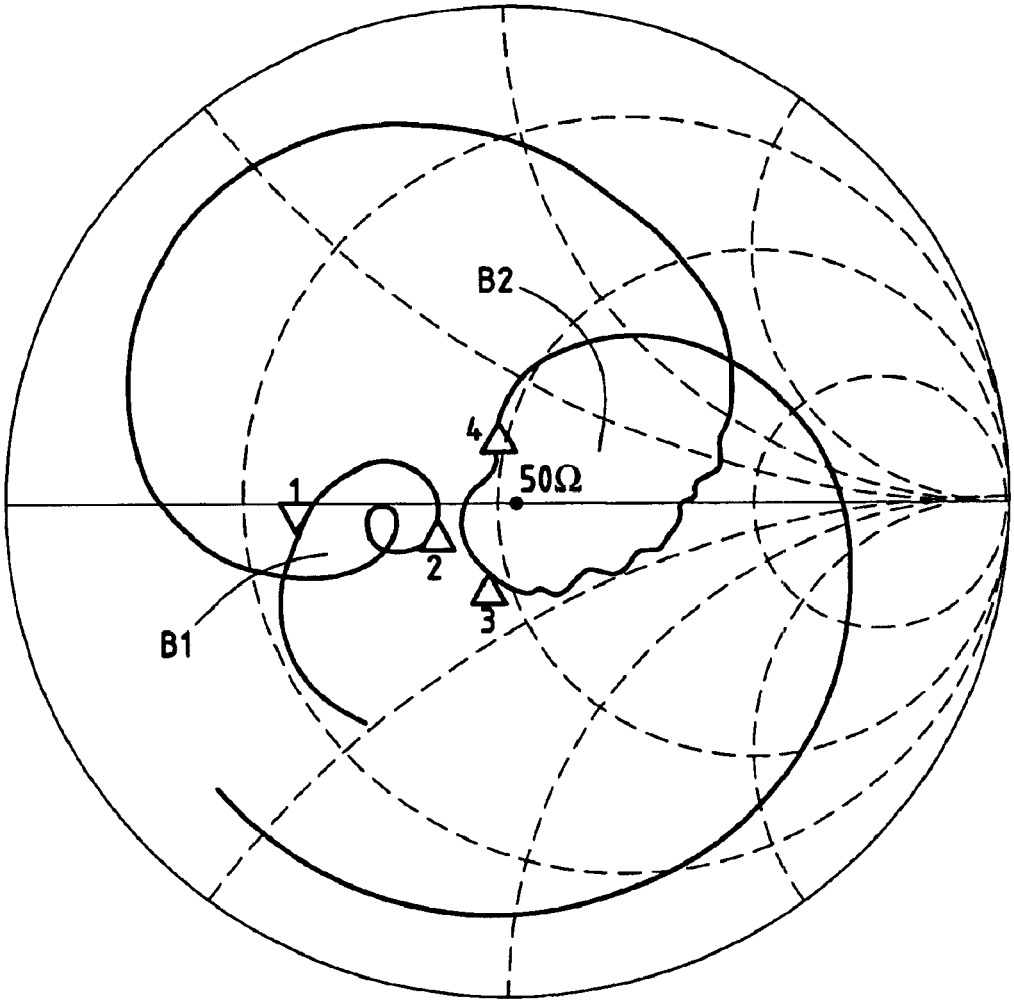
FIG. 9 is a Smith chart for an antenna in accordance with the invention.

FIG. 9 is a Smith chart for the same antenna with impedance plotted in polar coordinates as a function of frequency.

The chart shows that in the operating frequency ranges of the antenna, impedance is close or very close to 50 ohms, and the two loops B1 and B2 demonstrate that there are two well-marked frequency bands.

What is claimed is:

1. An internal antenna of small volume comprising:

a conductive ground plane;

a first conductive surface placed in an antenna plane substantially parallel to the ground plane and partially surrounding a portion of the antenna plane, and presenting first and second ends;

a second conductive surface forming a main radiating assembly disposed essentially in said portion of the antenna plane, said two conductive surfaces not being connected together by any conductive electrical connection;

an antenna conductor connected to said second conductive surface;

first electrical connection means for connecting a first end of the first conductive surface to a first zone of the ground plane; and second electrical connection means for connecting said first surface at least in the vicinity of the second end of the first conductive surface to a second zone of the ground plane that is distinct from the first zone;

the assembly constituted by said first conductive surface, the portion of the ground plane electrically interconnecting the first and second zones, and the two connection means presenting an opening.

2. An antenna according to claim 1, wherein said first and second conductive surfaces are made on a face of an insulating support or a dielectric substrate that is substantially parallel to the ground plane.

3. An antenna according to claim 2, wherein a portion of said second conductive surface is made on the second face of the insulating support or the dielectric substrate.

4. An antenna according to claim 1, wherein said first and second conductive surfaces are cut-out pieces of metal sheet.

5. An antenna according to claim 4, wherein said first and second electrical connection means are extensions of the piece of sheet forming the first conductive surface, said extensions being bent through a right angle and having ends bonded to the ground plane.

6. An antenna according to claim 1, wherein said opening is formed in said first conductive surface.

7. An antenna according to claim 1, wherein said opening is made in the ground plane on the path interconnecting said two zones.

8. An antenna according to claim 1, further including impedance-matching means between said first and second conductive surfaces.

9. An antenna according to claim 8, wherein said impedance-matching means are made by providing a predetermined distance between a portion of said first surface and a portion of the second surface.

10. An antenna according to claim 8, wherein said impedance-matching means are made by a capacitive component mounted between said two surfaces.

11. An antenna according to claim 1, further comprising second impedance-matching means mounted on the assembly constituted by the first conductive surface and the portion of the ground plane interconnecting said zones.

12. An antenna according to claim 11, wherein said second impedance-matching means are constituted by a slot in the ground plane.

13. An antenna according to claim 11, wherein said second impedance-matching means are constituted by a capacitive component mounted on said zone of said assembly constituted by the first conductive surface and said portion of the ground plane on the path between said zones.

* * * * *